US011189973B2

(12) United States Patent
Chen et al.

(10) Patent No.: US 11,189,973 B2
(45) Date of Patent: Nov. 30, 2021

(54) SOCKET CONNECTOR

(71) Applicant: SPEED TECH CORPORATION, Taoyuan (TW)

(72) Inventors: Chihcheng Chen, Taoyuan (TW); KuoHua Huang, Taoyuan (TW); Fayuan Hsieh, Taoyuan (TW)

(73) Assignee: SPEED TECH CORPORATION, Taoyuan (TW)

( * ) Notice: Subject to any disclaimer, the term of this patent is extended or adjusted under 35 U.S.C. 154(b) by 0 days.

(21) Appl. No.: 17/088,810

(22) Filed: Nov. 4, 2020

(65) Prior Publication Data

US 2021/0194187 A1 Jun. 24, 2021

(30) Foreign Application Priority Data

Dec. 20, 2019 (CN) ..... 201911323933.3

(51) Int. Cl.
*H01R 13/6597* (2011.01)
*H01R 13/11* (2006.01)
(Continued)

(52) U.S. Cl.
CPC ..... *H01R 13/6597* (2013.01); *H01R 13/11* (2013.01); *H01R 13/506* (2013.01);
(Continued)

(58) Field of Classification Search
CPC .. H01R 13/6597; H01R 13/11; H01R 13/506; H01R 13/6461; H01R 12/721; H01R 13/6599; H01R 13/6474
See application file for complete search history.

(56) References Cited

U.S. PATENT DOCUMENTS 10,411,376 B1 * 9/2019 Wang ..... H01R 12/716
2014/0127946 A1 * 5/2014 Ito ..... H01R 13/6599 439/629

(Continued)

FOREIGN PATENT DOCUMENTS

CN 107611717 A 1/2018
CN 108649366 A 10/2018

(Continued)

OTHER PUBLICATIONS

Chinese Office Action and Search Report, dated Oct. 23, 2020, for Chinese Application No. 201911323933.3, with an English translation of the Search Report.

*Primary Examiner* — Tho D Ta
(74) *Attorney, Agent, or Firm* — Birch, Stewart, Kolasch & Birch, LLP

(57) ABSTRACT

The present disclosure a socket connector including an insulating body, one or more conductive terminals and an adjusting element. The insulating body includes a mating surface, a mounting surface, an insertion slot and an installation slot. The conductive terminals include one or more signal terminals and one or more ground terminals. Each conductive terminal includes a fixing portion, an elastic arm and a mounting portion. The elastic arm is provided with a contact portion protruding into the insertion slot. The adjusting element is installed in the installation slot and used to adjust an electrical property. The adjusting element does not contact the adjacent signal terminals nor the adjacent ground terminals. A distance between the adjusting element and the adjacent ground terminals is smaller than a distance between the adjusting element and the adjacent signal terminals.

20 Claims, 17 Drawing Sheets

(51) Int. Cl.

| | |
|---|---|
| ***H01R 13/506*** | (2006.01) |
| ***H01R 13/6461*** | (2011.01) |
| *H01R 12/72* | (2011.01) |
| *H01R 12/73* | (2011.01) |
| *H01R 13/6599* | (2011.01) |
| *H01R 13/6474* | (2011.01) |

(52) U.S. Cl.
CPC ..... *H01R 13/6461* (2013.01); *H01R 12/721* (2013.01); *H01R 12/737* (2013.01); *H01R 13/6474* (2013.01); *H01R 13/6599* (2013.01)

(56) References Cited

U.S. PATENT DOCUMENTS

| | | | | |
|---|---|---|---|---|
| 2018/0294592 | A1* | 10/2018 | Huang | H01R 12/721 |
| 2019/0067876 | A1* | 2/2019 | Tang | H01R 13/6587 |
| 2019/0173209 | A1* | 6/2019 | Lu | H01R 12/00 |
| 2020/0266584 | A1* | 8/2020 | Lu | H01R 12/79 |
| 2021/0135389 | A1* | 5/2021 | Jiang | H01R 13/405 |

FOREIGN PATENT DOCUMENTS

| | | | |
|---|---|---|---|
| CN | 109301546 | A | 2/2019 |
| CN | 110277699 | A | 9/2019 |
| CN | 110429405 | A | 11/2019 |
| CN | 211208724 | U | 8/2020 |
| WO | WO 2017/007429 | A1 | 1/2017 |

* cited by examiner

SOCKET CONNECTOR

CROSS-REFERENCE TO RELATED APPLICATION

This patent application claims priority of a Chinese Patent Application No. 201911323933.3, filed on Dec. 20, 2019 and titled "SOCKET CONNECTOR", the entire content of which is incorporated herein by reference.

TECHNICAL FIELD

The present disclosure relates to a socket connector, which belongs to a technical field of electronic components.

BACKGROUND

A socket connector is usually used to be installed on a circuit board to allow a board-end connector to be plugged in to realize communication between the board-end connector and the circuit board. As electronic products have higher and higher requirements for signal transmission quality, more and more stringent requirements have been put forward on the electrical properties of the socket connectors.

SUMMARY

An object of the present disclosure is to provide a socket connector capable of adjusting electrical properties.

In order to achieve the above object, a socket connector of an embodiment of the present disclosure is provided. The socket connector of the embodiment includes an elongated insulating body, one or more conductive terminals fixed in the insulating body and an adjusting element. The insulating body includes a mating surface, a mounting surface disposed opposite to the mating surface, an insertion slot extending through the mating surface and an installation slot extending through the mounting surface. The conductive terminals include one or more signal terminals and one or more ground terminals. The conductive terminals are distributed on opposite sides of the insertion slot. Each conductive terminal includes a fixing portion, an elastic arm extending from one end of the fixing portion and a mounting portion extending from the other end of the fixing portion. The elastic arm is provided with a contact portion protruding into the insertion slot. The mounting portion is at least partially exposed on the mounting surface. The adjusting element is installed in the installation slot and used to adjust electrical properties. The adjusting element does not contact the adjacent signal terminals. The adjusting element does not contact the adjacent ground terminals. A distance between the adjusting element and the adjacent ground terminals is smaller than a distance between the adjusting element and the adjacent signal terminals.

Compared with the prior art, an embodiment of the present disclosure provides an adjusting element for adjusting the electrical properties of the socket connector, and the adjusting element does not contact the adjacent signal terminals and the adjacent ground terminals. The distance between the adjusting element and the adjacent ground terminals is smaller than the distance between the adjusting element and the adjacent signal terminals. With this arrangement, on one hand, the electrical properties of the socket connector can be adjusted through the electrical coupling of the adjusting element and the corresponding conductive terminals. On the other hand, by keeping the adjusting element away from the signal terminals relative to the ground terminals, the effect of the adjusting element on signal transmission is avoided.

DETAILED DESCRIPTION

Figure 1:
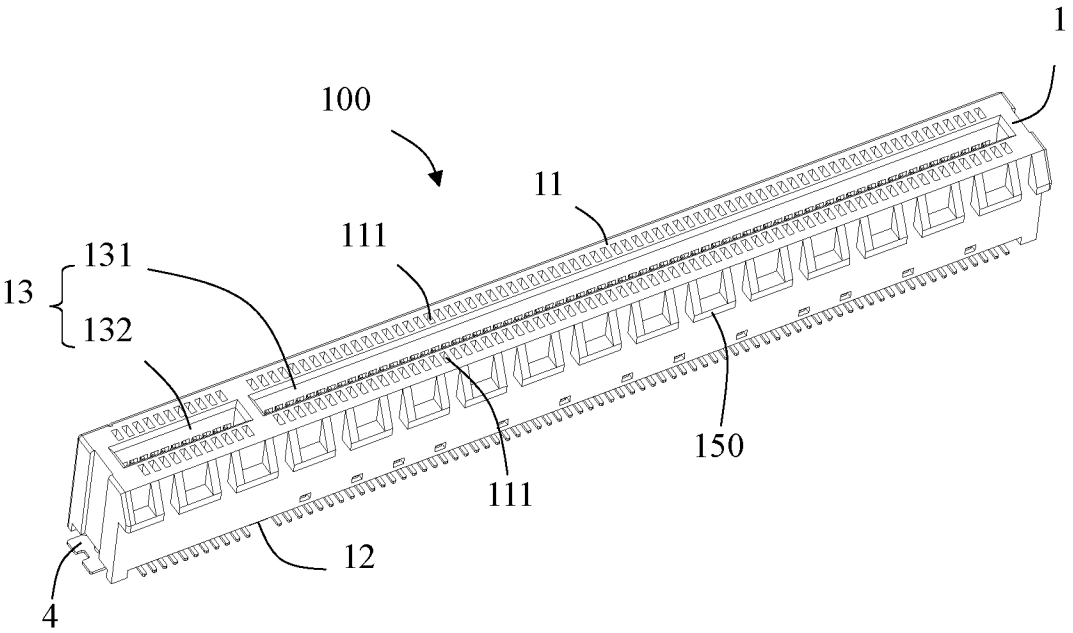
FIG. 1 is a perspective view of a socket connector in accordance with an embodiment of the present disclosure.
Figure 2:
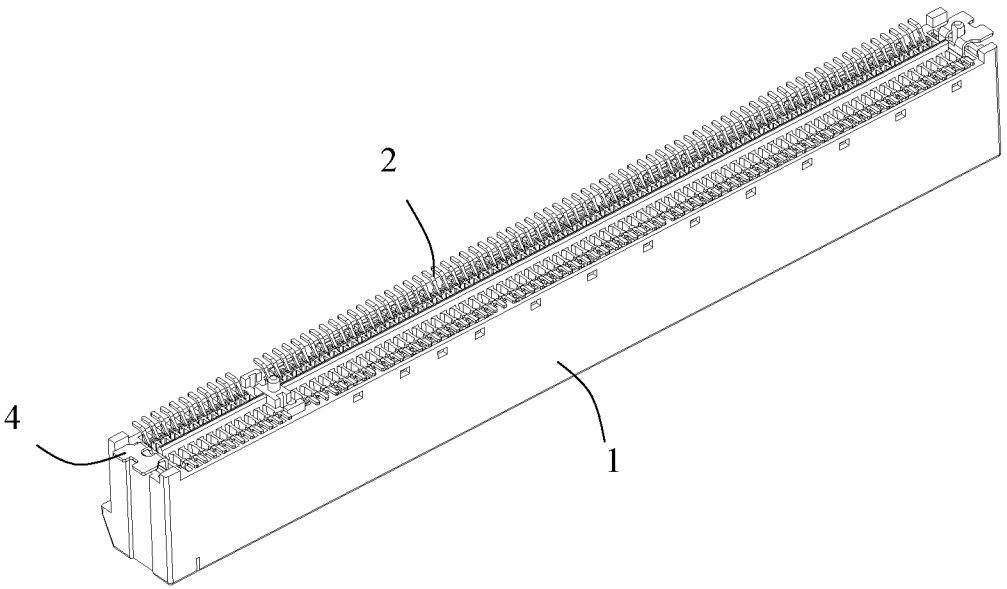
FIG. 2 is a perspective schematic view of FIG. 1 from another angle.
Figure 3:
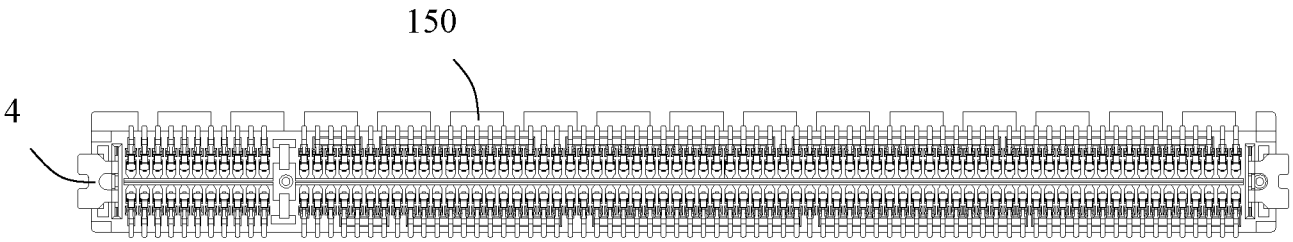
FIG. 3 is a bottom view of FIG. 1.
Figure 4:
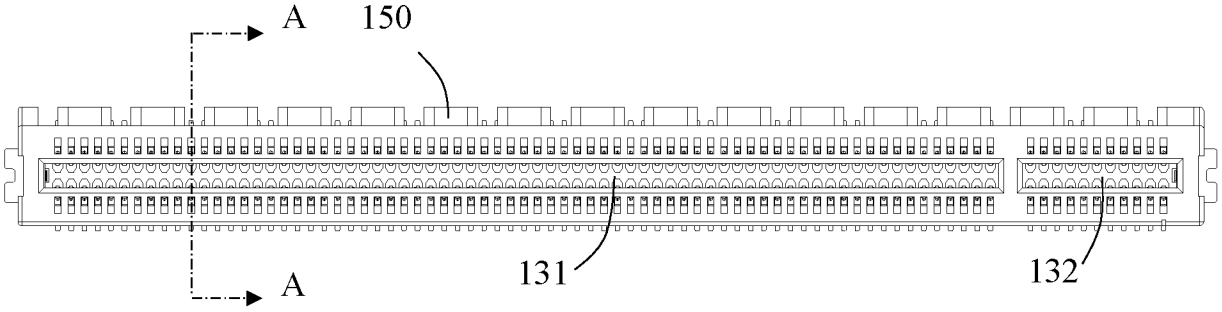
FIG. 4 is a top view of FIG. 1.

Referring to FIGS. 1 to 17, the present disclosure discloses a socket connector 100 including an elongated insulating body 1, a plurality of conductive terminals 2 fixed in the insulating body 1, an adjusting element 3 mounted in the insulating body 1 and used to adjust one or more electrical properties of the socket connector 100, and a pair of mounting parts 4 installed at opposite ends of the insulating body 1.

Figure 10:
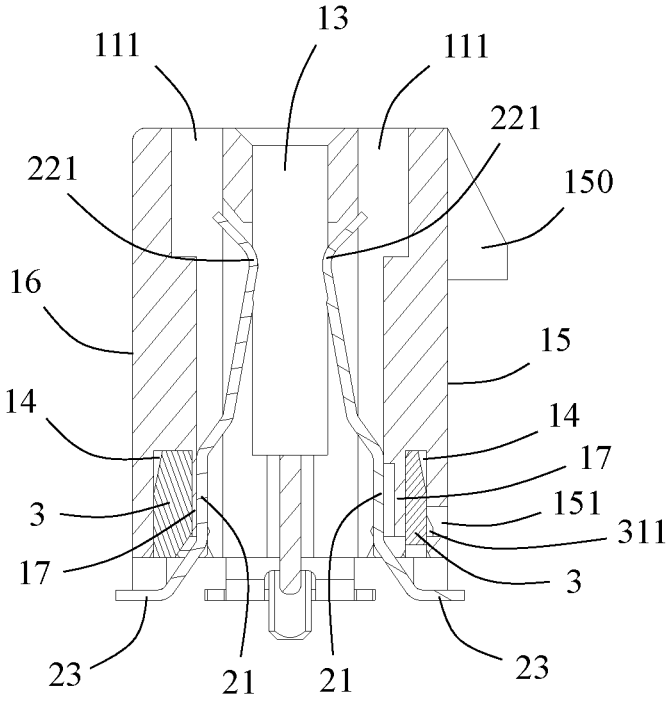
FIG. 10 is a schematic cross-sectional view taken along line A-A in FIG. 4.

The insulating body 1 includes a mating surface 11, a mounting surface 12 opposite to the mating surface 11, an insertion slot 13 extending through the mating surface 11, an installation slot 14 (see FIG. 10) extending through the mounting surface 12, and a first side wall 15 and a second side wall 16 located on opposite sides of the insertion slot 13. Referring to FIG. 1, in the illustrated embodiment of the present disclosure, the insertion slot 13 includes a first slot 131 and a second slot 132 which have different lengths and are separated from each other. The first side wall 15 is provided with one or more locking protrusions 150. The insertion slot 13 is used to install a circuit module with golden fingers (not shown). The locking protrusions 150 are used for locking with a fixing member pressed on the circuit module, so as to stably hold the circuit module on the socket connector 100. Referring to FIGS. 1 and 10, the insulating body 1 is provided with two rows of through holes 111 extending through the mating surface 11. The through holes 111 communicate with the corresponding conductive terminals 2 to provide a certain heat dissipation effect when the circuit module is electrically connected to the socket connector 100.

Figure 5:
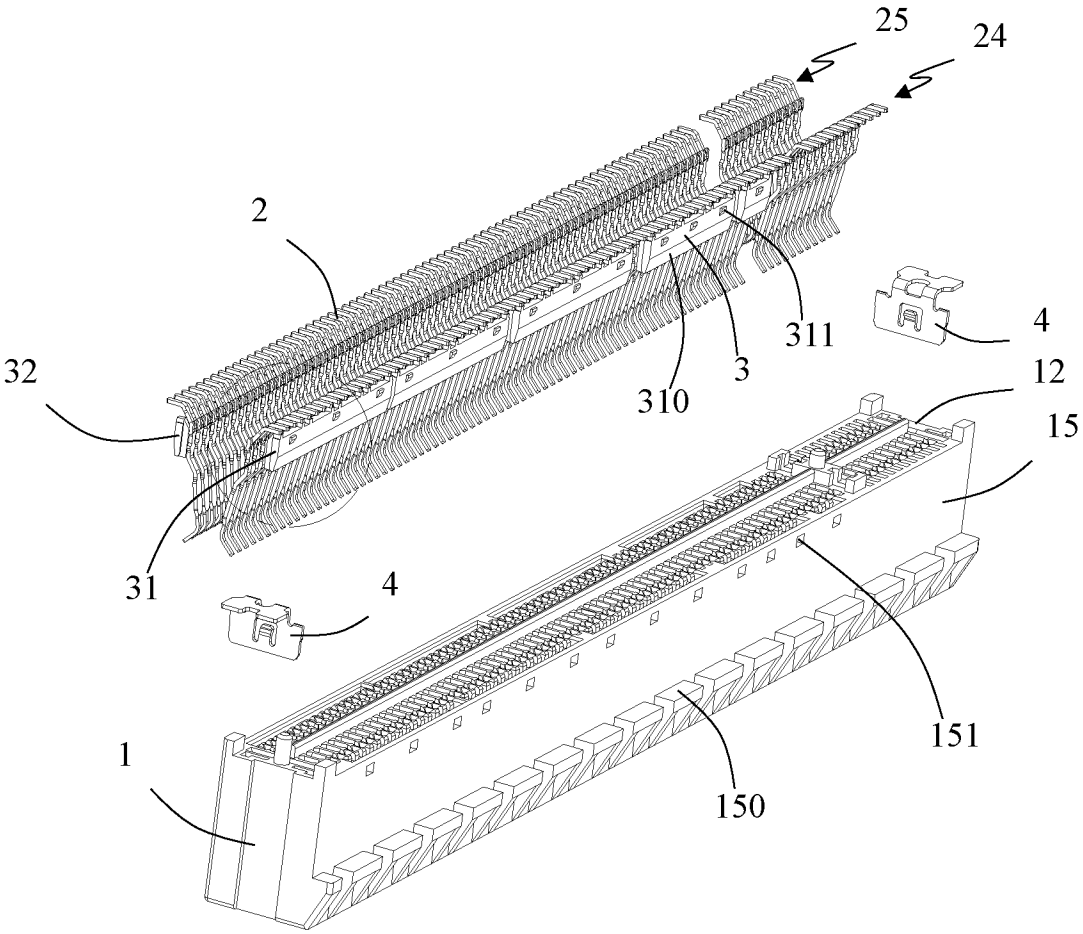
FIG. 5 is a partially exploded perspective view of FIG. 2.
Figure 6:
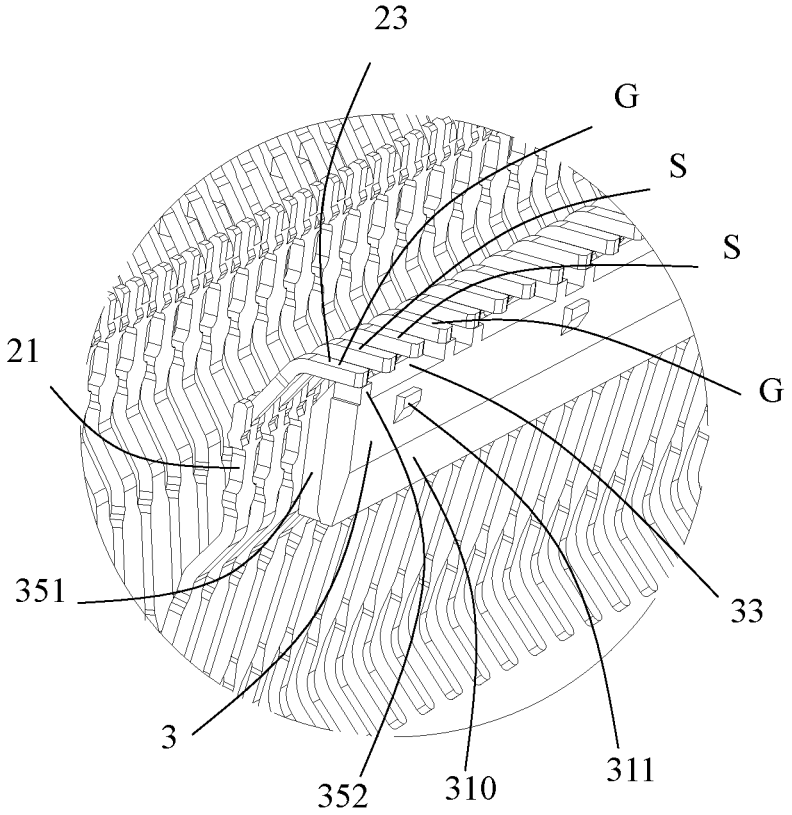
FIG. 6 is a partial enlarged view of a circled portion in FIG. 5.
Figure 7:
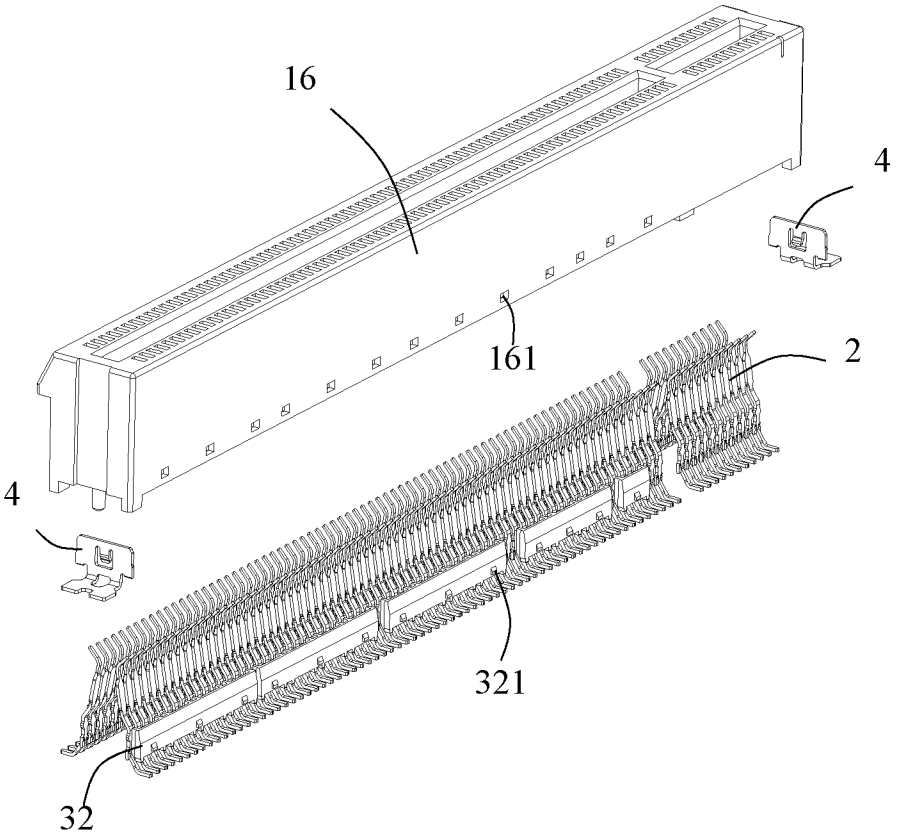
FIG. 7 is a partially exploded perspective view of FIG. 5 from another angle.
Figure 8:
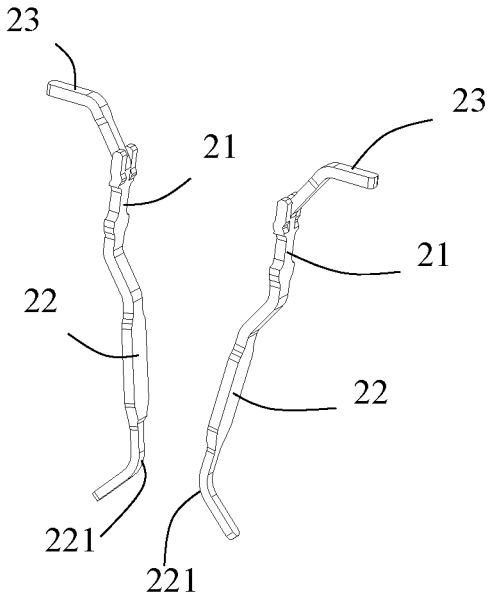
FIG. 8 is a perspective schematic view of two opposite terminals in FIG. 5.

Referring to FIGS. 5, 7 and 10, the first side wall 15 is provided with one or more first locking hole 151 extending outwardly through the first side wall 15 and communicating with the corresponding installation slot 14. The second side wall 16 is provided with one or more second locking holes 161 extending outwardly through the second side wall 16 and communicating with the corresponding installation slot 14. The first locking holes 151 and the second locking holes 161 are used for locking the adjusting element 3 to achieve a positioning function. In addition, when the adjusting element 3 needs to be disassembled, a tool is used to insert the first locking holes 151 and the second locking holes 161 from the outside so as to push against the adjusting element 3. As a result, the adjusting element 3 can be disassembled from the insulating body 1.

Referring to FIGS. 5, 6, 8 and 10, the conductive terminals 2 include one or more signal terminals S and one or more ground terminals G The plurality of conductive terminals 2 are symmetrically distributed on opposite sides of the insertion slot 13. Each conductive terminal 2 includes a fixing portion 21, an elastic arm 22 extending from one end of the fixing portion 21, and a mounting portion 23 extending from the other end of the fixing portion 21. The elastic arm 22 is provided with a contact portion 221 protruding into the insertion slot 13. The mounting portion 23 is at least partially exposed on the mounting surface 12. In the illustrated embodiment of the present disclosure, the mounting portions 23 are horizontal and used to be mounted to a circuit board by Surface Mounting Technology (SMT). Specifically, the plurality of conductive terminals 2 include a first row of conductive terminals 24 and a second row of conductive terminals 25. The first row of conductive terminals 24 and the second row of conductive terminals 25 are symmetrically arranged on opposite sides of the insertion slot 13. Each of the first row of conductive terminals 24 and the second row of conductive terminals 25 includes multiple groups of conductive terminals. Each group of conductive terminals includes two adjacent signal terminals S and two ground terminals G sandwiching the two signal terminals S. That is, each group of conductive terminals is arranged in a GSSG arrangement status.

Figure 11:
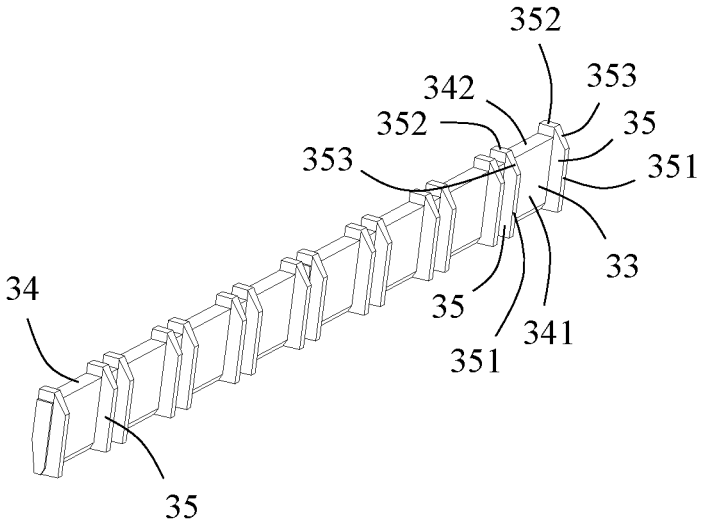
FIG. 11 is a perspective view of a part of the adjusting element in FIG. 9.
Figure 12:
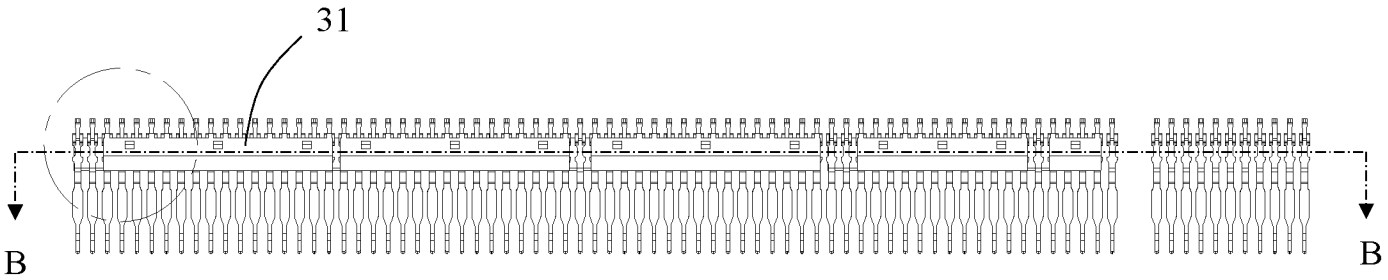
FIG. 12 is a right side view of a first row of conductive terminals, a second row of conductive terminals, a first row of adjusting elements, and a second row of adjusting elements in FIG. 5.
Figure 13:
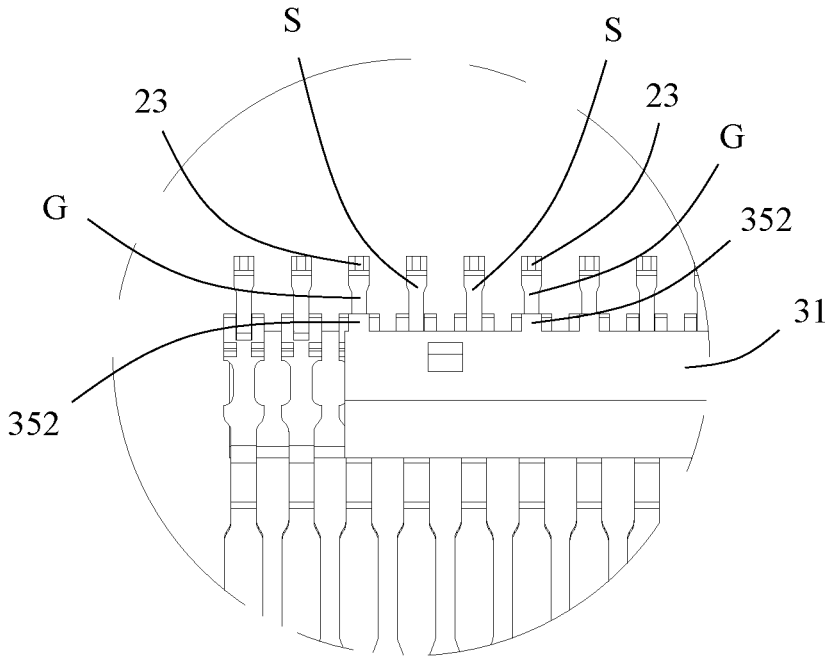
FIG. 13 is a partial enlarged view of a circled portion in FIG. 12.
Figure 14:
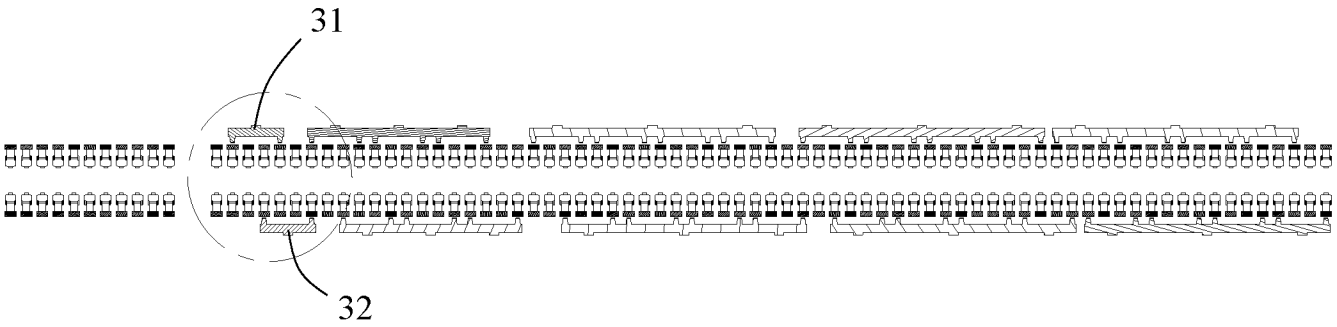
FIG. 14 is a schematic cross-sectional view taken along line B-B in FIG. 12.
Figure 15:
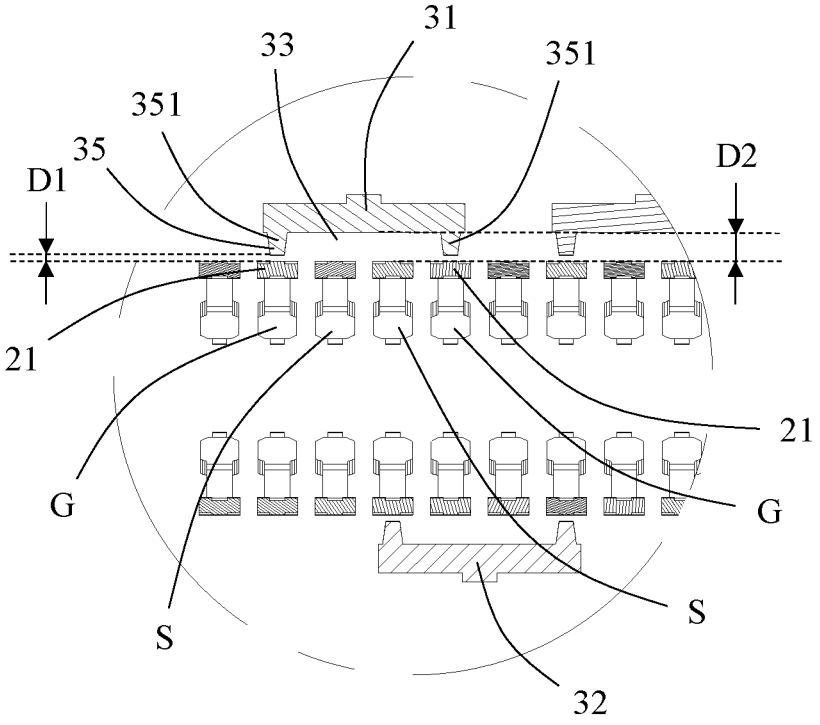
FIG. 15 is a partial enlarged view of a circled portion in FIG. 14.
Figure 16:
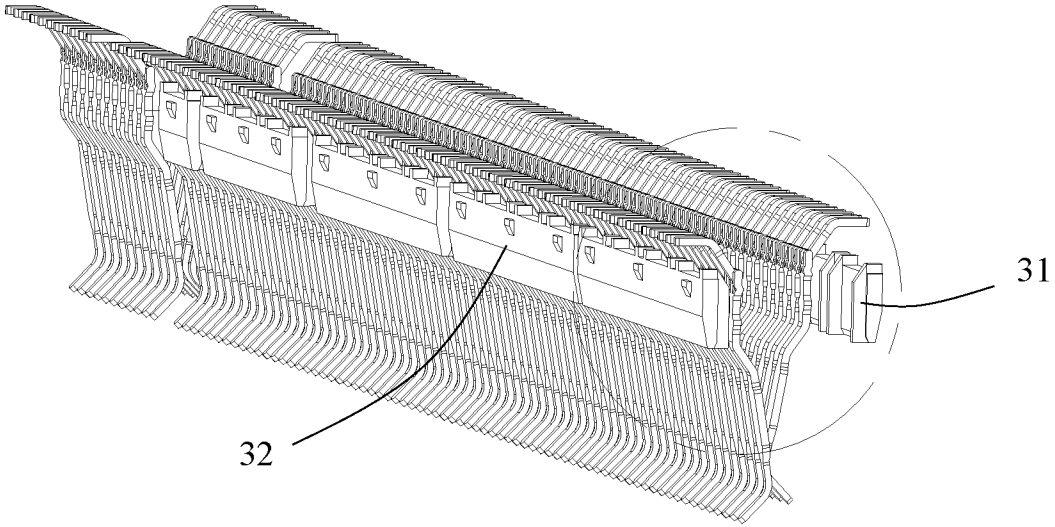
FIG. 16 is a perspective view of the first row of conductive terminals, the second row of conductive terminals, the first row of adjusting elements, and the second row of adjusting elements in FIG. 5 from another angle, in which part of the first row of conductive terminals is omitted.
Figure 17:
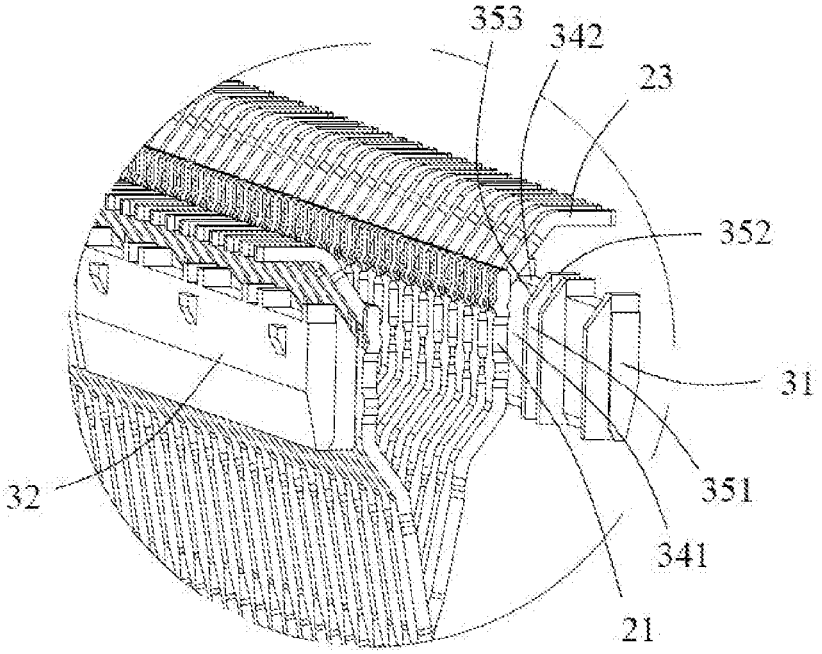
FIG. 17 is a partial enlarged view of a circled portion in FIG. 16.

The adjusting element 3 is installed in the installation slot 14. The adjusting element 3 is not in contact with the adjacent signal terminals S. In an embodiment of the present disclosure, the adjusting element 3 is a conductive glue. Referring to FIGS. 11, 13 and 15, in which FIG. 13 is a partial enlarged view of the circled part in FIG. 12, and FIG. 15 is a partial enlarged view of the circled part in FIG. 14. The adjusting element 3 includes a plate body 34 and one or more convex ribs 35. The plurality of convex ribs 35 are provided on the plate body 34. Each convex rib 35 protrudes toward the adjacent ground terminals G. Referring to FIGS. 11, 13, 15 and 17, in which FIG. 17 is a partial enlarged view of the circled part in FIG. 16. In this embodiment, each convex rib 35 includes a first convex portion 351 and a second convex portion 352. The plate body 34 includes a first surface 341 and a second surface 342 perpendicular to the first surface 341. The first convex portions 351 protrude from the first surface 341 toward the fixing portions 21 of the adjacent ground terminals G The second convex portions 352 protrude from the second surface 342 toward the mounting portions 23 of the adjacent ground terminals G In this embodiment, the first convex portions 351 are connected with the corresponding second convex portions 352. In this embodiment, a connection position between each first convex portion 351 and the corresponding second convex portion 352 forms a chamfer 353. The adjusting element 3 is provided with one or more avoidance recesses 33 corresponding to the signal terminals S between two adjacent convex ribs 35.

A distance between the adjusting element 3 and the adjacent ground terminals G is smaller than a distance between the adjusting element 3 and the adjacent signal terminals S. For example, referring to FIG. 15, a shortest distance between the convex rib 35 of the adjusting element 3 and the adjacent ground terminals G is named as a first distance D1. A shortest distance between the avoidance recesses 33 of the adjusting element 3 and the adjacent signal terminals S is named as a second distance D2. The first distance D1 is smaller than the second distance D2. The first distance D1 will be small enough to cause electrical coupling between the adjusting element 3 and the ground terminals G, thereby adjusting the electrical properties. The adjusting element 3, for example, but not limited to, can absorb or shield electromagnetic waves, reduce interference and noise, or improve overall high-frequency performance. The second distance D2 will be large enough to prevent the electrical coupling between the adjusting element 3 and the signal terminals S from affecting the quality of signal transmission. Here, the meaning of electrical coupling or electrical connection is, for example, but not limited to: regardless of whether the two elements are actually in contact with each other, when the two elements are electrically coupled, the two elements will correspondingly generate electrical, electromagnetic or signal changes or influences. In this embodiment, the range of the first distance D1 is 0.02 mm to 0.20 mm, but it is not limited to this. Referring to FIG. 10, in the illustrated embodiment of the present disclosure, the adjusting element 3 is separated from the fixing portions 21 of the adjacent signal terminals S by a partition wall 17, thereby further reducing the risk of contact between the adjusting element 3 and the signal terminals S. Preferably, the partition wall 17 and the insulating body 1 are integrally formed to facilitate manufacturing.

Figure 9:
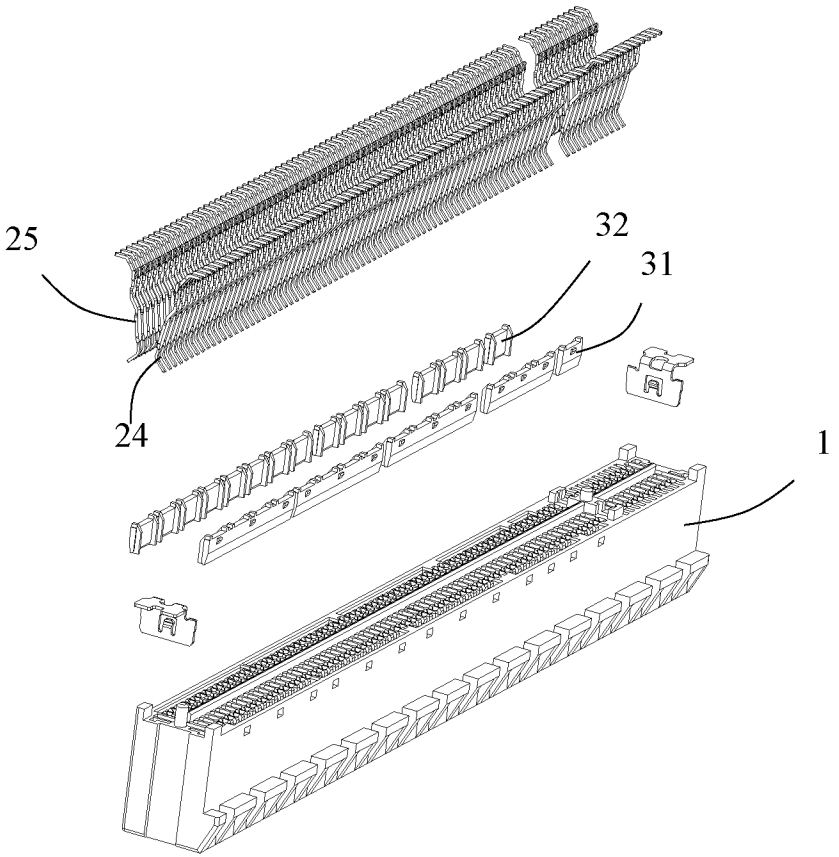
FIG. 9 is a further perspective exploded view of FIG. 5.

Referring to FIGS. 5 and 9, the adjusting element 3 includes a first row of adjusting elements 31 and a second row of adjusting elements 32. The first row of adjusting elements 31 are located outside of the first row of conductive terminals 24. The second row of adjusting elements 32 are located outside of the second row of conductive terminals 25. In the illustrated embodiment of the present disclosure, the first row of adjusting elements 31 include a plurality of discontinuous adjusting elements 3. The second row of adjusting elements 32 also include a plurality of discontinuous adjusting elements 3. In the illustrated embodiment of the present disclosure, the adjusting element 3 is in contact with the ground terminals G to increase the grounding area and achieve a better shielding effect. Specifically, referring to FIGS. 6 and 11, the first row of adjusting elements 31 and the second row of adjusting elements 32 are respectively provided with one or more avoidance recesses 33 corresponding to the signal terminals S. The avoidance recesses 33 are located between two adjacent first convex portions 351 and between two adjacent second convex portions 352. In this embodiment, neither the first convex portion 351 nor the second convex portion 352 will contact the ground terminals G For example, the first convex portion 351 will not contact the fixing portions 21 of the ground terminals G In addition, the second convex portion 352 will not contact the mounting portions 23 of the ground terminals G In some embodiments, the first convex portion 351 does not contact the fixing portions 21 of the ground terminals G. However, the mounting portions 23 of the ground terminals G abut against the second convex portion 352. In some embodiments, the first convex portion 351 contacts the fixing portions 21 of the ground terminals G, and the mounting portions 23 of the ground terminals G abut against the second convex portion 352.

In addition, the adjusting element 3 is provided with an inclined guide surface 310 to facilitate its insertion into the installation slot 14. The adjusting element 3 is mounted to the insulating body 1 together with the conductive terminals 2 or before the conductive terminals 2 are mounted to the insulating body 1. As a result, the adjusting element 3 can be more easily mounted inside the insulating body 1, which avoids mounting confliction with the conductive terminals 2. As shown in FIG. 10, the mounting portion 23 extends along a first direction (i.e., a horizontal direction) perpendicular to a second direction (a vertical direction) along which the adjusting element 3 is installed into the installation slot 14. The mounting portion 23 at least partially overlaps the adjusting element 3 along the second direction so that the adjusting element 3 can be prevented from escaping from the insulating body 1. The first row of adjusting elements 31 are provided with a plurality of first protrusions 311 which are fixed in the first locking holes 151, and the second row of adjusting elements 32 are provided with a plurality of second protrusions 321 which are fixed in the second locking holes 161.

Compared with the prior art, by providing the adjusting element 3 in an embodiment of the present disclosure, on one hand, it can improve the electrical properties of the socket connector 100 through the electrical coupling of the adjusting element 3 and the corresponding ground terminals G; on the other hand, by making the adjusting element 3 far away from the signal terminals S with respect to the ground terminals G, it can avoid the influence of the adjusting element 3 on signal transmission.

The above embodiments are only used to illustrate the present disclosure and not to limit the technical solutions described in the present disclosure. The understanding of this specification should be based on those skilled in the art. Descriptions of directions, although they have been described in detail in the above-mentioned embodiments of the present disclosure, those skilled in the art should understand that modifications or equivalent substitutions can still be made to the application, and all technical solutions and improvements that do not depart from the spirit and scope of the application should be covered by the claims of the application.

What is claimed is:

1. A socket connector, comprising:

an elongated insulating body comprising a mating surface, a mounting surface disposed opposite to the mating surface, an insertion slot extending through the mating surface and an installation slot extending through the mounting surface;

a plurality of conductive terminals fixed in the insulating body, the conductive terminals comprising a signal terminal and a ground terminal, the conductive terminals being distributed on opposite sides of the insertion slot, each conductive terminal comprising a fixing portion, an elastic arm extending from one end of the fixing portion and a mounting portion extending from the other end of the fixing portion, the elastic arm being provided with a contact portion protruding into the insertion slot, the mounting portion being at least partially exposed on the mounting surface;

wherein the socket connector further comprises an adjusting element installed in the installation slot and used to adjust an electrical property, the adjusting element does not contact the adjacent signal terminal, the adjusting element does not contact the adjacent ground terminal, and a distance between the adjusting element and the adjacent ground terminal is smaller than a distance between the adjusting element and the adjacent signal terminal.

2. The socket connector according to claim 1, wherein the adjusting element is a conductive glue.

3. The socket connector according to claim 1, wherein the adjusting element comprises a plate body and a convex rib, and the convex rib is provided on the plate body and protrudes toward the adjacent ground terminal.

4. The socket connector according to claim 3, wherein the convex rib comprises a first convex portion and a second convex portion, the first convex portion protrudes from a first surface of the plate body toward the fixing portion of the adjacent ground terminal, the second convex portion protrudes from a second surface of the plate body toward the mounting portion of the adjacent ground terminal, and the second surface is perpendicular to the first surface.

5. The socket connector according to claim 1, wherein a partition wall is provided to separate the adjusting element and the fixing portion of the adjacent signal terminal, and the partition wall and the insulating body are integrally formed.

6. The socket connector according to claim 1, wherein the conductive terminals comprise a first row of conductive terminals and a second row of conductive terminals, the adjusting element comprises a first row of adjusting elements and a second row of adjusting elements, the first row of adjusting elements are located on an outer side of the first row of conductive terminals away from the second row of conductive terminals, and the second row of adjusting elements are located on an outer side the second row of conductive terminals away from the first row of adjusting elements.

7. The socket connector according to claim 6, wherein the first row of conductive terminals and the second row of conductive terminals are symmetrically arranged on opposite sides of the insertion slot, the first row of adjusting elements comprise a plurality of discontinuous adjusting elements, and the second row of adjusting elements also comprise a plurality of discontinuous adjusting elements.

8. The socket connector according to claim 6, wherein both the first row of conductive terminals and the second row of conductive terminals comprise multiple groups of conductive terminals, each group of conductive terminals comprises two adjacent signal terminals and two ground terminals sandwiching the two adjacent signal terminals, and the first row of adjusting elements and the second row of adjusting elements are provided with avoidance recesses corresponding to the signal terminals.

9. The socket connector according to claim 1, wherein the adjusting element is provided with an inclined guide surface to facilitate insertion into the installation slot.

10. The socket connector according to claim 1, wherein the insulating body comprises a first side wall and a second side wall which are located on opposite sides of the insertion slot, the first side wall defines a first locking hole extending outwardly through the first side wall and communicating with corresponding installation slot, the second side wall defines a second locking hole extending outwardly through the second side wall and communicating with corresponding installation slot, the adjusting element comprises a first row of adjusting element and a second row of adjusting element, the first row of adjusting element comprises a first protrusion fixed in the first locking hole, and the second row of adjusting element comprises a second protrusion fixed in the second locking hole.

11. The socket connector according to claim 1, wherein the insulating body comprises a locking protrusion located on one side of the insertion slot.

12. A socket connector, comprising:

an elongated insulating body comprising a mating surface, a mounting surface disposed opposite to the mating surface, an insertion slot extending through the mating surface and an installation slot extending through the mounting surface;

a plurality of conductive terminals fixed in the insulating body, the conductive terminals comprising a plurality of signal terminals and a plurality of ground terminals, the conductive terminals being distributed on opposite sides of the insertion slot, each conductive terminal comprising a fixing portion, an elastic arm and a mounting portion, each elastic arm being provided with a contact portion protruding into the insertion slot; and an adjusting element mounted to the insulating body together with the conductive terminals or before the conductive terminals are mounted to the insulating body, the adjusting element is installed in the installation slot and used to adjust an electrical property, the adjusting element does not contact the adjacent signal terminals, the adjusting element does not contact the adjacent ground terminals, and a distance between the adjusting element and the adjacent ground terminals is smaller than a distance between the adjusting element and the adjacent signal terminals.

13. The socket connector according to claim 12, wherein the adjusting element comprises a plate body and a plurality of convex ribs, and the convex ribs are provided on the plate body and protrude toward the adjacent ground terminals.

14. The socket connector according to claim 13, wherein the convex ribs comprise a plurality of first convex portions and a plurality of second convex portions, the first convex portions protrude from a first surface of the plate body toward the fixing portions of the adjacent ground terminals, the second convex portions protrude from a second surface of the plate body toward the mounting portions of the adjacent ground terminals, and the second surface is perpendicular to the first surface.

15. The socket connector according to claim 12, wherein a partition wall is provided to separate the adjusting element and the fixing portions of the adjacent signal terminals, and the partition wall and the insulating body are integrally formed.

16. The socket connector according to claim 12, wherein the conductive terminals comprise a first row of conductive terminals and a second row of conductive terminals, the adjusting element comprises a first row of adjusting elements and a second row of adjusting elements, the first row of adjusting elements are located on an outer side of the first row of conductive terminals away from the second row of conductive terminals, and the second row of adjusting elements are located on an outer side the second row of conductive terminals away from the first row of conductive terminals.

17. The socket connector according to claim 16, wherein the first row of conductive terminals and the second row of conductive terminals are symmetrically arranged on opposite sides of the insertion slot, the first row of adjusting elements comprise a plurality of discontinuous adjusting elements, and the second row of adjusting elements also comprise a plurality of discontinuous adjusting elements.

18. The socket connector according to claim 16, wherein both the first row of conductive terminals and the second row of conductive terminals comprise multiple groups of conductive terminals, each group of conductive terminals comprises two adjacent signal terminals and two ground terminals sandwiching the two adjacent signal terminals, and the first row of adjusting elements and the second row of adjusting elements are provided with avoidance recesses corresponding to the signal terminals.

19. The socket connector according to claim 12, wherein the mounting portion is at least partially exposed on the mounting surface, and the mounting portion extends along a first direction perpendicular to a second direction along which the adjusting element is installed into the installation slot.

20. The socket connector according to claim 19, wherein the mounting portion at least partially overlaps the adjusting element along the second direction.

* * * * *